US010088800B2

(12) United States Patent
Tsuji

(10) Patent No.: US 10,088,800 B2
(45) Date of Patent: Oct. 2, 2018

(54) IMAGE FORMING APPARATUS

(71) Applicant: KYOCERA Document Solutions Inc., Osaka-shi, Osaka (JP)

(72) Inventor: Hirofumi Tsuji, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/495,764

(22) Filed: Apr. 24, 2017

(65) Prior Publication Data

US 2017/0315478 A1 Nov. 2, 2017

(30) Foreign Application Priority Data

Apr. 27, 2016 (JP) ..... 2016-089884

(51) Int. Cl.

*G03G 21/18* (2006.01)
*G03G 15/16* (2006.01)
*G03G 21/16* (2006.01)

(52) U.S. Cl.

CPC ..... *G03G 21/1832* (2013.01); *G03G 15/1605* (2013.01); *G03G 21/1842* (2013.01); *G03G 21/168* (2013.01); *G03G 21/1671* (2013.01); *G03G 2221/1609* (2013.01)

(58) Field of Classification Search

CPC .. G03G 15/75; G03G 21/1671; G03G 21/168; G03G 21/1814; G03G 21/1828; G03G 21/1832; G03G 21/1842; G03G 2221/1609

USPC ..... 399/107, 110, 111, 116, 119

See application file for complete search history.

(56) References Cited

U.S. PATENT DOCUMENTS 6,115,565 A * 9/2000 Noda ..... G03G 21/007 399/102
2004/0101328 A1* 5/2004 Kimura ..... G03G 15/751 399/111

FOREIGN PATENT DOCUMENTS

JP 2013101300 A 5/2013

* cited by examiner

*Primary Examiner* — Benjamin Schmitt
(74) *Attorney, Agent, or Firm* — Alleman Hall Creasman & Tuttle LLP

(57) ABSTRACT

An intermediate transfer unit is attached to a position in the main body portion from a front side of the main body portion along the depth direction in a detachable manner. A cover portion extends in the depth direction and along a region of the outer circumferential surface of a rotating image carrying member that is more on a downstream side in a rotation direction of the image carrying member than the top region of the rotating image carrying member that is in contact with the intermediate transfer belt. A shield portion is provided on a portion of an upper surface of the cover portion that is closer to a front surface of the main body portion than the intermediate transfer belt. The shield portion has a taper surface that is inclined diagonally downward from a top surface of the shield portion toward the intermediate transfer belt.

4 Claims, 5 Drawing Sheets

IMAGE FORMING APPARATUS

INCORPORATION BY REFERENCE

This application is based upon and claims the benefit of priority from the corresponding Japanese Patent Application No. 2016-089884 filed on Apr. 27, 2016, the entire contents of which are incorporated herein by reference.

BACKGROUND

The present disclosure relates to an electrophotographic image forming apparatus.

In the electrophotographic image forming apparatuses, there is known a tandem-type color image forming apparatus. In addition, the color image forming apparatus includes an intermediate transfer belt and a plurality of photoconductor drums respectively corresponding to a plurality of colors of toner. The intermediate transfer belt is an endless belt and rotates while in contact with the valid areas for image formation provided on the outer circumferential surfaces of the plurality of rotating photoconductor drums, and toner images are transferred from the plurality of photoconductor drums to the intermediate transfer belt.

In addition, it is known that an intermediate transfer unit including the intermediate transfer belt and a frame portion that rotatably supports the intermediate transfer belt, is attached from a front side of a main body portion along a depth direction, in a detachable manner.

SUMMARY

An image forming apparatus according to an aspect of the present disclosure includes a drum-like image carrying member, an intermediate transfer unit, a cover portion, and a shield portion. The image carrying member is disposed such that a longitudinal direction thereof matches a depth direction of a main body portion of the image forming apparatus, and configured to rotate while carrying a toner image on a valid area for image formation provided on an outer circumferential surface thereof. The intermediate transfer unit includes an endless intermediate transfer belt and a frame portion and is attached to a position above the image carrying member in the main body portion from a front side of the main body portion along the depth direction in a detachable manner, the intermediate transfer belt rotating while in contact with the valid area in a top region of the rotating image carrying member such that the toner image is transferred from the image carrying member thereto, the frame portion rotatably supporting the intermediate transfer belt. The cover portion extends in the depth direction and along a region of the outer circumferential surface of the rotating image carrying member that is more on a downstream side in a rotation direction of the image carrying member than the top region of the rotating image carrying member that is in contact with the intermediate transfer belt. The shield portion is provided on a portion of an upper surface of the cover portion that is closer to a front surface of the main body portion than the intermediate transfer belt, and configured to shield a space between the upper surface of the cover portion and a lower surface of the frame portion of the intermediate transfer unit. The shield portion has a taper surface that is inclined diagonally downward from a top surface of the shield portion toward the intermediate transfer belt.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Outlined Configuration of Image Forming Apparatus 10]

An image forming apparatus 10 according to the embodiment of the present disclosure is a tandem-type color image forming apparatus that forms an image with toner 9*a* on a sheet by an electrophotography method. The sheet is a sheet-like image formation medium such as a sheet of paper or an envelope.

Figure 1:
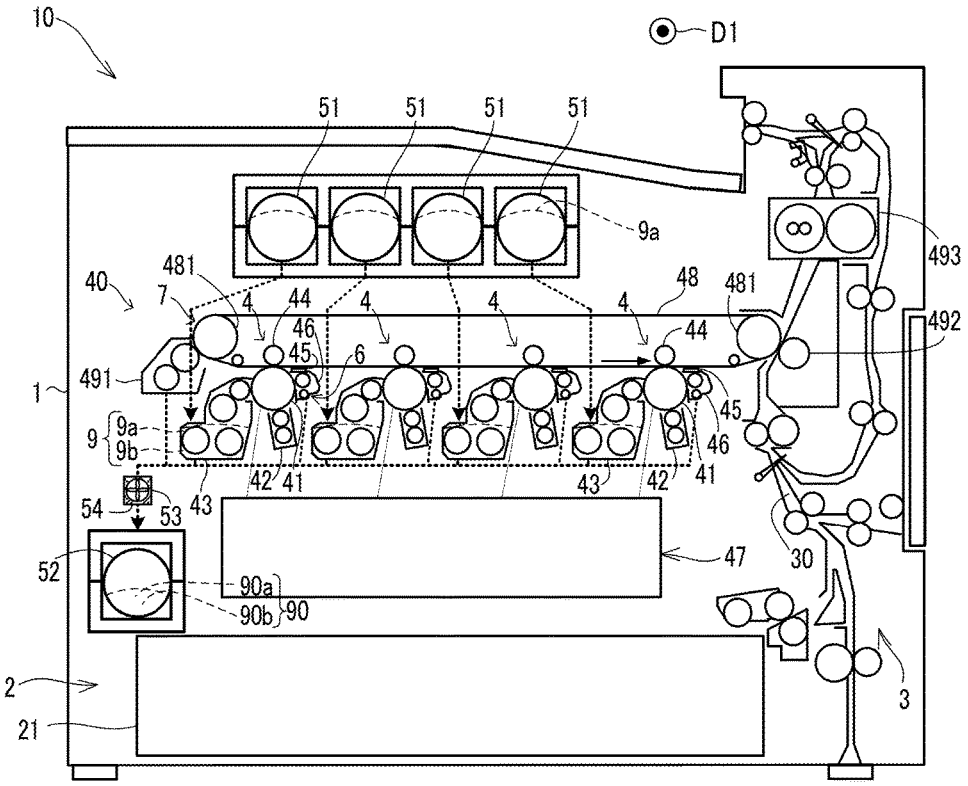
FIG. 1 is a configuration diagram of an image forming apparatus according to an embodiment of the present disclosure.
Figure 2:
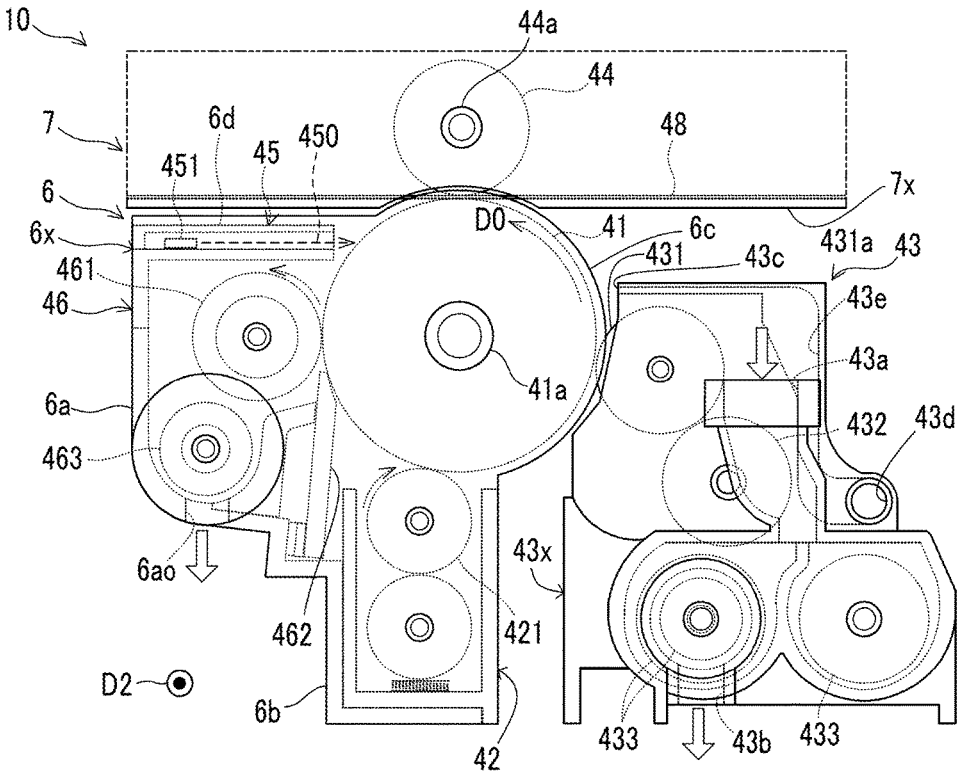
FIG. 2 is a configuration diagram of a photoconductor drum and its peripheral in the image forming apparatus according to the embodiment.
Figure 3:
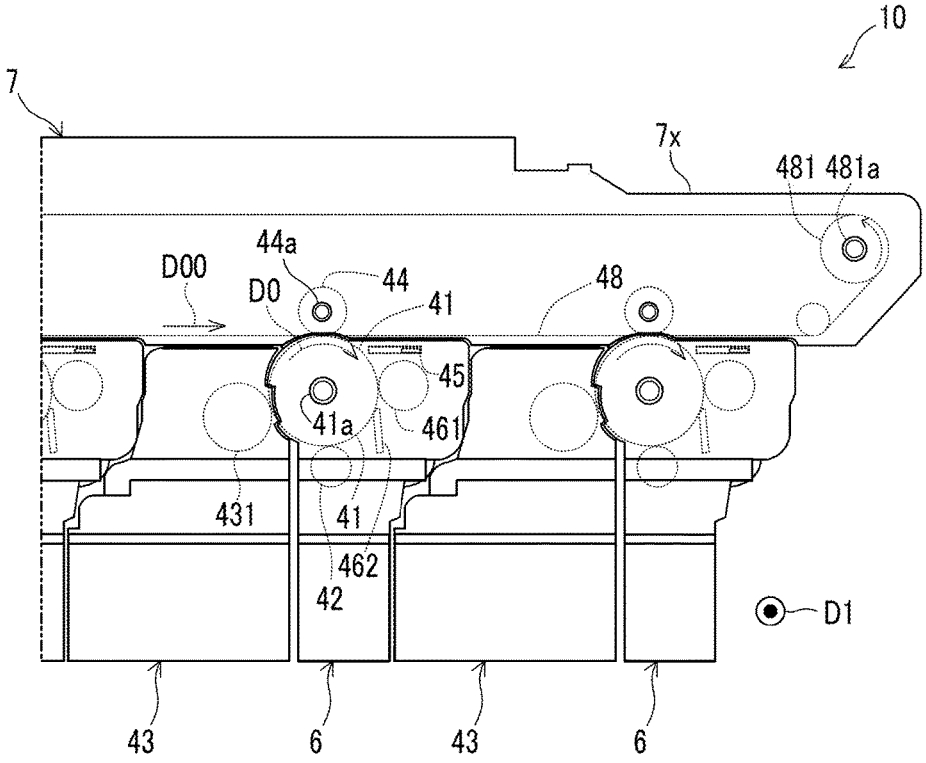
FIG. 3 is a front view of a part of a drum unit, a developing unit, and an intermediate transfer unit in the image forming apparatus according to the embodiment.
Figure 4:
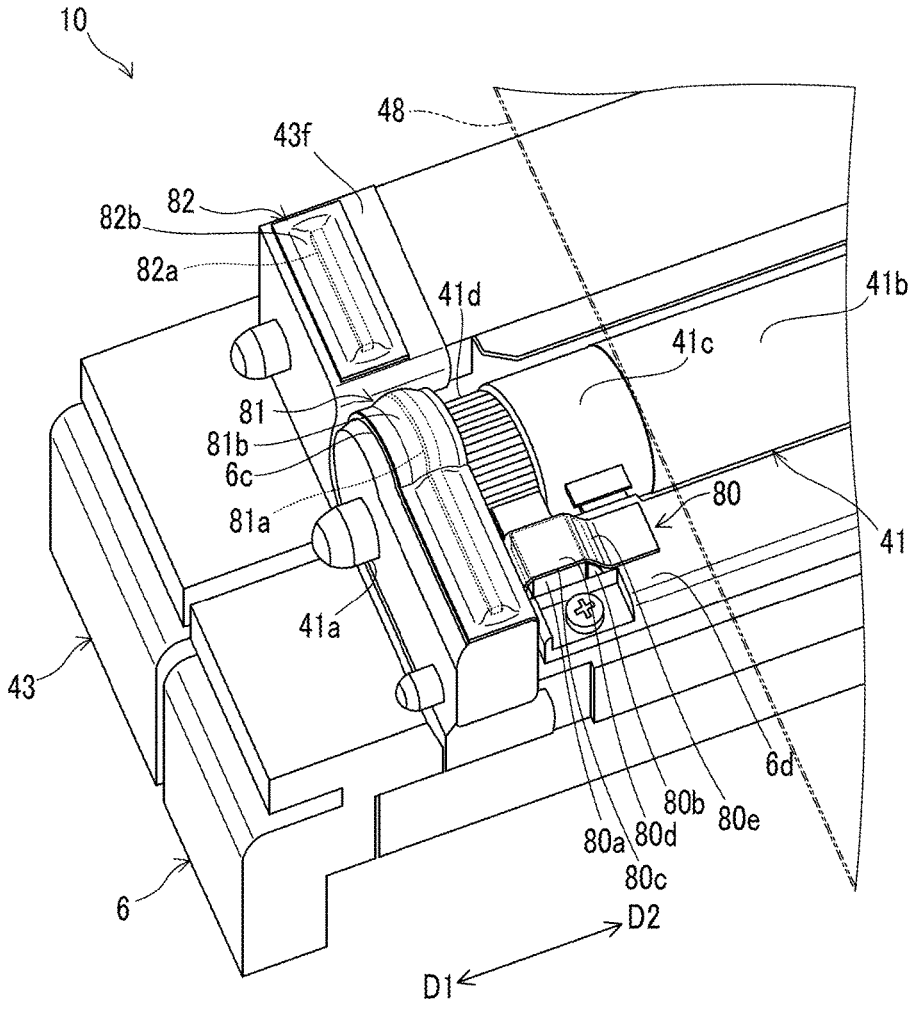
FIG. 4 is a perspective view of a front-side end portion of the drum unit and the developing unit in the image forming apparatus according to the embodiment.
Figure 5:
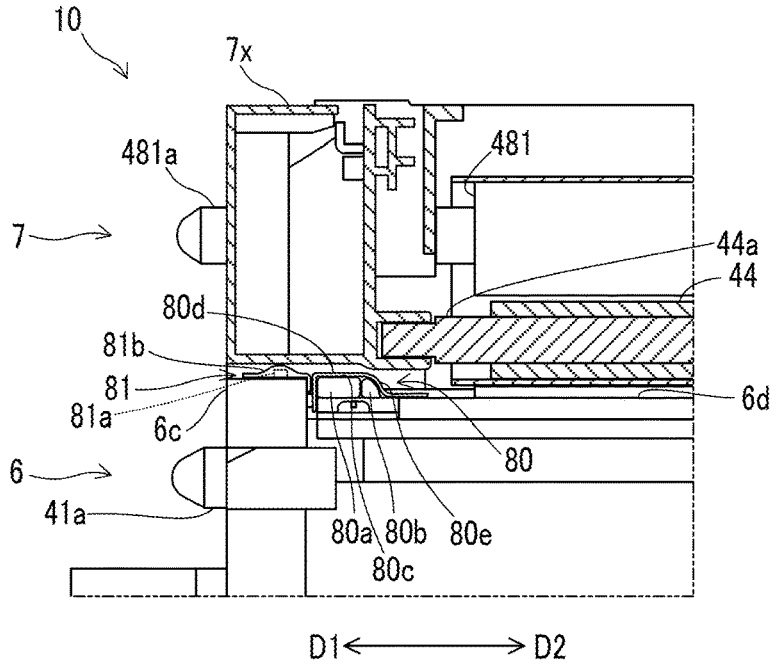
FIG. 5 is a diagram showing a side of the drum unit and a cross section of the intermediate transfer unit in the image forming apparatus according to the embodiment.

The image forming apparatus 10 includes, in a main body portion 1, a sheet supply portion 2, a sheet conveying portion 3, an image forming portion 40, a toner replenishing portion 51, and a developer collecting portion 52. A frontward direction D1 shown in FIG. 1, FIG. 3 to FIG. 5 is a direction heading from a rear side of the main body portion 1 toward a front side, and a rearward direction D2 shown in FIG. 2, FIG. 4, FIG. 5 is a direction heading from the front side of the main body portion 1 toward the rear side.

The image forming portion 40 executes an image forming process of forming a toner image on the sheet. The image forming portion 40 executes the image forming process by using a two-component developer 9 that includes toner 9*a* and carrier 9*b*.

The image forming portion 40 includes a plurality of image generating portions 4, a laser scanning unit 47, an intermediate transfer belt 48, a belt cleaning portion 491, a sheet transfer portion 492, a fixing portion 493, a toner replenishing portion 51, and a developer collecting portion 52. Each of the image generating portions 4 includes a photoconductor drum 41, a charging unit 42, a developing unit 43, a belt transfer portion 44, an electricity removing portion 45, and a drum cleaning portion 46.

The photoconductor drum 41, the charging unit 42, the electricity removing portion 45, and the drum cleaning portion 46 are unitized as a drum unit 6. In addition, the intermediate transfer belt 48 is unitized as an intermediate transfer unit 7 together with a pair of belt support rollers 481 and a plurality of belt transfer portions 44, wherein the pair of belt support rollers 481 rotatably support the intermediate transfer belt 48.

The drum unit 6, the developing unit 43, and the intermediate transfer unit 7 are attached to the main body portion 1 from a front side thereof along a depth direction D1-D2 in a detachable manner.

The sheet supply portion 2 feeds a sheet to a sheet conveyance path 30, and the sheet conveying portion 3 conveys the sheet along the sheet conveyance path 30. The toner replenishing portion 51 replenishes unused toner 9*a* to the developing unit 43.

A rotation shaft 41*a* of the photoconductor drum 41 that is a drum-like image carrying member, is rotatably supported. The photoconductor drum 41 is disposed such that its longitudinal direction matches the depth direction D1-D2. As shown in FIG. 4, coupling portions 41*d* that couple the photoconductor drum 41 with the rotation shaft 41*a* are respectively provided at opposite ends of the photoconductor drum 41.

A partial region of an outer circumferential surface of the photoconductor drum 41 in the longitudinal direction is a valid area 41*b* in which a toner image is formed, and regions on both sides of the valid area 41*b* are invalid areas 41*c* in which the toner image is not formed (see FIG. 4). It is noted that in FIG. 4, the intermediate transfer belt 48 is represented by an imaginary line (two-dot chain line).

The photoconductor drum 41 rotates, and the charging unit 42 charges the valid area 41*b* of the outer circumferential surface of the photoconductor drum 41. Furthermore, the laser scanning unit 47 writes an electrostatic latent image on the valid area 41*b* of the outer circumferential surface of the photoconductor drum 41 by scanning a laser beam thereon.

Furthermore, the developing unit 43 develops the electrostatic latent image with the toner 9*a* included in the two-component developer 9 and thereby forms a toner image. The photoconductor drum 41 is an example of the drum-like image carrying member that rotates while carrying the toner image on the valid area 41*b* of its outer circumferential surface.

Subsequently, the roller-like belt transfer portion 44 transfers the toner image from the surface of the photoconductor drum 41 to the intermediate transfer belt 48. The intermediate transfer belt 48 is an endless belt and rotates while in contact with the valid area 41*b* of the surface of the photoconductor drum 41, and thereby the toner image is transferred to the intermediate transfer belt 48 from the photoconductor drum 41.

The electricity removing portion 45 removes electricity from the outer circumferential surface of the photoconductor drum 41 by irradiating the surface with electricity removal light after the toner image is transferred therefrom to the intermediate transfer belt 48. The drum cleaning portion 46 removes residual toner 9*a* from the surface of the photoconductor drum 41 after the toner image is transferred therefrom to the intermediate transfer belt 48.

The sheet transfer portion 492 transfers the toner image from the intermediate transfer belt 48 to the sheet. The belt cleaning portion 491 removes residual toner 9*a* from the intermediate transfer belt 48. The fixing portion 493 fixes the toner image to the sheet by heating.

[Drum Unit 6]

As shown in FIG. 2, the drum unit 6 includes a casing 6*x* that integrally holds the photoconductor drum 41, the charging unit 42, the electricity removing portion 45, and the drum cleaning portion 46. The casing 6*x* is composed of a plurality of integrally assembled resin members.

The photoconductor drum 41, the charging unit 42, the electricity removing portion 45, the drum cleaning portion 46, and the casing 6*x* are disposed such that their longitudinal directions match the depth direction D1-D2 of the main body portion 1. The casing 6*x* includes a cleaning cover portion 6*a*, a charging unit support portion 6*b*, drum support portions 6*c*, and an electricity removal cover portion 6*d*.

The cleaning cover portion 6*a* constitutes a housing of the drum cleaning portion 46, rotatably supports a cleaning roller 461 and a toner conveyance screw 463 included in the drum cleaning portion 46, and supports a cleaning blade 462.

The cleaning roller 461 and the cleaning blade 462 rub the residual toner 9*a* off the outer circumferential surface of the photoconductor drum 41. Furthermore, the toner conveyance screw 463 conveys the toner 9*a* removed from the photoconductor drum 41, to a toner discharge port 6*ao* formed at a rear-side end of the cleaning cover portion 6*a*.

The charging unit support portion 6*b* supports the charging unit 42 that includes a charging roller 421. The drum support portions 6*c* rotatably support the rotation shaft 41*a* of the photoconductor drum 41 respectively at positions close to the front surface and the rear surface of the main body portion 1. It is noted that the drum support portions 6*c* are an example of the image carrying member support portion.

The electricity removal cover portion 6*d* covers an electricity removal light source 451 that emits electricity removal light 450, and forms a light path of the electricity removal light 450 heading for the surface of the photoconductor drum 41. The electricity removal cover portion 6*d* is formed to extend in the depth direction D1-D2 of the main body portion 1. The electricity removal cover portion 6*d* extends along a region of the outer circumferential surface of the rotating photoconductor drum 41 that is more on the downstream side in a rotation direction D0 of the photoconductor drum 41 than a top region of the outer circumferential surface of the rotating photoconductor drum 41 that is in contact with the intermediate transfer belt 48.

[Developing Unit 43]

The developing unit 43 executes a developing process by a so-called interactive touchdown method. In the developing unit 43, a developing housing 43*x* stores the toner 9*a* and the carrier 9*b*, whereas a developing roller 431, a magnetic roller 432, and a pair of developer conveying screws 433 rotate in the developing housing 43*x*.

The developing housing 43*x*, the developing roller 431, the magnetic roller 431, the pair of developer conveying screws 433 are arranged such that the longitudinal directions thereof extend along the depth direction D1-D2 of the main body portion 1. The carrier 9*b* is stored in the developing housing 43*x* in advance, and the toner 9*a* is replenished from the toner replenishing unit 5 as necessary.

A receiving port 43*a* is formed at a rear-side end of the developing housing 43*x*, wherein the toner 9*a* fed from the toner replenishing unit 5 is received through the receiving port 43*a* (see FIG. 2). The pair of developer conveying screws 433 cyclically convey the two-component developer 9 in the developing housing 43*x*. A part of the cyclically conveyed two-component developer 9 is discharged from a developer discharge port 43*b* formed at the rear-side end of the developing housing 43*x*.

The magnetic roller 432 that is cylindrical and contains a magnet in its inside, rotates while carrying the toner 9*a* and the carrier 9*b*. Furthermore, the magnetic roller 432 supplies the toner 9*a* to the developing roller 431.

The developing roller 431 rotates while carrying the toner 9*a* supplied from the magnetic roller 432, and supplies the toner 9*a* to the valid area 41*b* of the outer circumferential surface of the photoconductor drum 41. This allows the electrostatic latent image on the surface of the photoconductor drum 41 to be developed as the toner image.

It is noted that the developing roller 431 includes a spacer roll (not shown). The spacer roll rotates while in contact with the invalid areas 41*c* of the outer circumferential surface of the photoconductor drum 41, thereby keeping the interval between the developing roller 431 and the photoconductor drum 41 constant.

In the developing housing 43*x*, a ventilation duct 43*e* communicating an air inlet port 43*c* with an air exhaust port 43*d* is formed, wherein the air inlet port 43*c* is an opening facing the photoconductor drum 41, and the air exhaust port 43*d* is an opening formed in the rear-side end of the developing housing 43*x*.

Air that contains toner 9*a* floating between the developing housing 43*x* and the photoconductor drum 41 passes through the ventilation duct 43*e*. A suction fan 53 shown in FIG. 1 generates an airflow heading from the air inlet port 43*c* toward the air exhaust port 43*d*. The floating toner 9*a* is passed through an air filter 54 together with air by the suction fan 53, and trapped by the air filter 54.

The toner 9*a* discharged from the toner discharge port 6*ao* of the drum cleaning portion 46, the two-component developer 9 discharged from the developer discharge port 43*b* of the developing unit 43, the toner 9*a* removed from the intermediate transfer belt 48 by the belt cleaning portion 491, and the toner 9*a* trapped by the air filter 54, are conveyed along an intermediate conveyance path (not shown), and then collected in the developer collecting portion 52.

[Intermediate Transfer Unit 7]

The intermediate transfer unit 7 includes a frame portion 7*x* that rotatably supports each of the intermediate transfer belt 48 and the plurality of belt transfer portions 44. The frame portion 7*x* rotatably supports rotation shafts 481*a* of the pair of belt support rollers 481 and a rotation shaft 44*a* of the belt transfer portion 44 at a position close to the front surface of the main body portion 1 and at a position close to the rear surface thereof.

Meanwhile, in the image forming apparatus 10, as the plurality of photoconductor drums 41, drive mechanisms of the plurality of photoconductor drums 41, and the intermediate transfer belt 48 rotate, airflows are generated between the photoconductor drums 41 and the intermediate transfer belt 48. In addition, the drive mechanisms are densely disposed in a region in the main body portion 1 close to the rear surface thereof.

As a result, in the surroundings of the top regions of the plurality of rotating photoconductor drums 41, the airflows are likely to float from the rear side to the front side in the depth direction D1-D2 of the main body portion 1, and are likely to float to the downstream side in the rotation direction D0 of the photoconductor drum 41 and the a rotation direction D00 of the intermediate transfer belt 48.

When floating toner generated in the surroundings of the top regions of the plurality of rotating photoconductor drums 41 is carried by the airflows, the floating toner may leak to outside the developing units 43 and the drum units 6 including the photoconductor drums 41 in a region in the main body portion 1 close to the front surface thereof.

The leaked toner 9*a* may smear the hands and clothes of the user in the region of the main body portion 1 close to the front surface thereof which is often accessed by the user. In addition, the toner 9*a* leaked from a drum unit 6 may generate a noise image in an adjacent drum unit 6.

As described above, the image forming apparatus 10 includes the suction fan 53 that sucks the floating toner via the receiving port 43*c* of the developing unit 43 that faces the photoconductor drum 41. However, in a case where the airflow has a strong power in the rotation direction D0 of the photoconductor drum 41, the suction fan 53 may not suck the floating toner completely.

In addition, when the suction force of the suction fan 53 is too strong, the toner image on the photoconductor drum 41 may be deformed. Accordingly, there is a limit in strengthening the suction force of the suction fan 53.

On the other hand, if a partition wall for stopping the airflow is provided on a portion of the drum unit 6 that is close to the front surface of the main body portion 1, when the intermediate transfer unit 7 is pulled toward the front side of the main body portion 1, the intermediate transfer belt 48 may be caught by the partition wall and damaged.

The image forming apparatus 10 includes a shield portion 80 configured to prevent the floating toner from leaking in a region in the main body portion 1 close to the front surface thereof without interrupting the smooth attachment and detachment of the intermediate transfer unit 7 (see FIG. 4, FIG. 5). The following describes the shield portion 80.

[Shield Portion 80]

As shown in FIG. 4 and FIG. 5, the shield portion 80 is provided on a portion of the upper surface of the electricity removal cover portion 6*d* that is closer to the front surface of the main body portion 1 than the intermediate transfer belt 48. The shield portion 80 shields a space between the upper surface of the electricity removal cover portion 6*d* and a lower surface of a front-side portion of the frame portion 7*x* of the intermediate transfer unit 7. The shield portion 80 is provided in each of the plurality of drum units 6.

The shield portion 80 has a taper surface 80*e* that is inclined diagonally downward from a top surface 80*d* thereof toward the intermediate transfer belt 48. That is, the taper surface 80*e* is inclined diagonally downward in the second direction D2.

The shield portion 80, in the region in the main body portion 1 close to the front surface thereof, shields the airflow heading from a space between the top region of the rotating photoconductor drum 41 and the intermediate transfer belt 48 to the downstream side in the rotation direction D0 of the photoconductor drum 41. In this case, the floating toner between the top region of the rotating photoconductor drum 41 and the intermediate transfer belt 48 is efficiently sucked from the receiving port 43*c* of the developing unit 43 and trapped by the air filter 54.

Accordingly, in the image forming apparatus 10, floating toner generated in the surroundings of the top regions of the plurality of rotating photoconductor drums 41 hardly leaks to outside the developing units 43. As a result, it is possible to prevent the toner 9*a* from smearing the hands and clothes of the user in the region in the main body portion 1 close to the front surface thereof which is often accessed by the user. Furthermore, it is possible to prevent a noise image from being generated in a drum unit 6 due to the toner 9*a* leaked from an adjacent drum unit 6.

Figure 6:
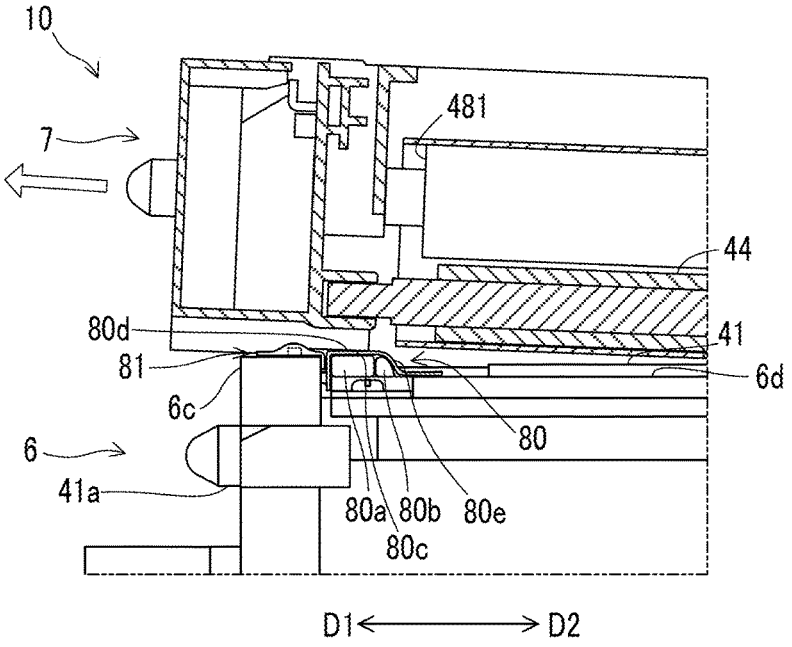
FIG. 6 is a diagram showing a side of the drum unit and a cross section of the intermediate transfer unit that is being removed in the image forming apparatus according to the embodiment.

In addition, as shown in FIG. 6, when the intermediate transfer unit 7 is pulled out from the main body portion 1 in the frontward direction D1, the inclined taper surface 80*e* of the shield portion 80 prevents a front-side edge of the intermediate transfer belt 48 from being caught by the shield portion 80.

In the present embodiment, the shield portion 80 includes a first base seat portion 80*a*, a second base seat portion 80*b*, and a pile sheet member 80*c*, wherein the second base seat portion 80*b* is softer than the first base seat portion 80*a*, and the surface of the pile sheet member 80*c* is a pile fabric.

The first base seat portion 80*a* is fixed to the upper surface of the electricity removal cover portion 6*d*. The second base seat portion 80*b* is fixed to the upper surface of the electricity removal cover portion 6*d* to be on the intermediate transfer belt 48 side of the first base seat portion 80*a*, namely, to be adjacent to the rear side of the main body portion 1.

The first base seat portion 80*a* is an elastic member made of a material that has a low compression residual strain and is relatively hard, such as PORON™. On the other hand, the second base seat portion 80*b* is an elastic member made of a material that is excellent in buffering capacity, such as foamed rubber.

The pile sheet member 80*c* is fixed to the electricity removal cover portion 6*d* by adhesive, tacky adhesive or the like in a state of covering the first base seat portion 80*a* and the second base seat portion 80*b* that are fixed in a state of being adjacent to each other.

A portion of the pile sheet member 80*c* covering the first base seat portion 80*a* forms the top surface 80*d* of the shield portion 80, and a portion of the pile sheet member 80*c* covering the second base seat portion 80*b* forms the taper surface 80*e* on the intermediate transfer belt 48 side. That is, the taper surface 80*e* of the shield portion 80 located on the intermediate transfer belt 48 side is formed from a pile fabric.

The pile sheet member 80*c* has a low friction resistance against the intermediate transfer belt 48 made of rubber, and smoothly guides the intermediate transfer belt 48. Furthermore, even when the intermediate transfer belt 48 forcefully comes into contact with the taper surface 80*e* of the shield portion 80, the second base seat portion 80*b* is elastically deformed, thereby relieving an impact given to the intermediate transfer belt 48.

In addition, in each of the drum units 6, a first low friction portion 81 is provided on the upper surface of the drum support portion 6*c* located close to the front surface of the main body portion 1. The upper surface of the drum support portion 6*c* close to the front surface of the main body portion 1 faces the lower surface of the frame portion 7*x* located close to the front surface of the main body portion 1.

Similarly, a second low friction portion 82 is provided on a surface of the developing housing 43*x* that faces the lower surface of the frame portion 7*x* located close to the front surface of the main body portion 1.

The first low friction portion 81 and the second low friction portion 82 face the lower surface of the frame portion 7*x* located close to the front surface of the main body portion 1, and have a lower friction resistance with respect to the intermediate transfer belt 48 than the upper surfaces of the drum support portion 6*c* and the developing housing 43*x*.

The first low friction portion 81 may include, as one example, a third base seat portion 81*a* that projects from the upper surface of the drum support portion 6*c*, and a pile seat member 81*b* that covers the third base seat portion 81*a*. Similarly, the second low friction portion 82 may include a fourth base seat portion 82*a* that projects from the upper surface of the developing housing 43*x*, and a pile seat member 82*b* that covers the fourth base seat portion 82*a*.

The pile seat member 81*b* is fixed to the drum support portion 6*c* by adhesive, tacky adhesive or the like in a state of covering the third base seat portion 81*a*. Similarly, the pile seat member 82*b* is fixed to the developing housing 43*x* by adhesive, tacky adhesive or the like in a state of covering the fourth base seat portion 82*a*.

The third base seat portion 81*a* and the fourth base seat portion 82*a* may be, for example, elastic members made of foamed rubber, that are fixed to the upper surface of the drum support portion 6*c* and the upper surface of the developing housing 43*x*, respectively. The pile seat members 81*b* and 82*b* are, as is the case with the second base seat portion 80*b*, sheet members whose surfaces are formed from a pile fabric.

In the state where the drum unit 6, the developing unit 43, and the intermediate transfer unit 7 are attached to the main body portion 1, the head top portions of the first low friction portion 81 and the second low friction portion 82 are in contact with the lower surface of the frame portion 7*x* located close to the front surface of the main body portion 1.

When the intermediate transfer unit 7 is attached to or detached from the main body portion 1, there is a possibility that the frame portion 7*x* of the intermediate transfer unit 7 and the intermediate transfer belt 48 may rub the upper surfaces of the developing housing 43*x* and the drum support portion 6*c* that is located higher than the top region of the rotating photoconductor drum 41.

The first low friction portion 81 and the second low friction portion 82 prevent the intermediate transfer unit 7 from being damaged by rubbing the drum support portion 6*c* and the developing housing 43*x*.

When viewed from a direction perpendicular to the depth direction D 1-D2 of the main body portion 1, the first low friction portion 81 and the second low friction portion 82 are each formed in a shape of a mountain, and are inclined diagonally downward from their top surfaces to the front side and the rear side of the main body portion 1 (see FIG. 4, FIG. 5).

As a result, when the intermediate transfer unit 7 is attached or detached, an edge of the intermediate transfer belt 48 is hardly caught by the first low friction portion 81 and the second low friction portion 82.

As described above, with the adoption of the image forming apparatus 10, it is possible to prevent the floating toner from leaking in the region in the main body portion 1 close to the front surface thereof, without interrupting a smooth attachment/detachment of the intermediate transfer unit 7.

Application Examples

In the image forming apparatus 10, the pile sheet members 80*c*, 81*b* and 82*b* that constitute a part of the shield portion 80, the first low friction portion 81, and the second low friction portion 82 may be formed from a material other than the pile sheet, such as a raised sheet that has a high sliding characteristic as the pile sheet.

In addition, in the drum unit 6, the electricity removing portion 45 may not be provided between the drum cleaning portion 46 and the intermediate transfer belt 48. In this case, the drum unit 6 may include a partition plate that separates between the drum cleaning portion 46 and the intermediate transfer belt 48. In addition, the shield portion 80 may be provided on the upper surface of the partition plate.

The partition plate is an example of the cover portion that is disposed to extend along a region of the outer circumferential surface of the rotating photoconductor drum 41 that is more on the downstream side in the rotation direction D0 of the photoconductor drum 41 than the top region of the rotating photoconductor drum 41 that is in contact with the intermediate transfer belt 48.

It is noted that the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a drum-like image carrying member disposed such that a longitudinal direction thereof matches a depth direction of a main body portion of the image forming apparatus, and configured to rotate while carrying a toner image on a valid area for image formation provided on an outer circumferential surface thereof;

an intermediate transfer unit including an endless intermediate transfer belt and a frame portion and attached to a position above the image carrying member in the main body portion from a front side of the main body portion along the depth direction in a detachable manner, the intermediate transfer belt rotating while in contact with the valid area in a top region of the rotating image carrying member such that the toner image is transferred from the image carrying member thereto, the frame portion rotatably supporting the intermediate transfer belt;

a cover portion extending in the depth direction and along a region of the outer circumferential surface of the rotating image carrying member that is more on a downstream side in a rotation direction of the image carrying member than the top region of the rotating image carrying member that is in contact with the intermediate transfer belt; and a shield portion provided on a portion of an upper surface of the cover portion that is closer to a front surface of the main body portion than the intermediate transfer belt, and configured to shield a space between the upper surface of the cover portion and a lower surface of the frame portion of the intermediate transfer unit, wherein the shield portion has a taper surface that is inclined diagonally downward from a top surface of the shield portion toward the intermediate transfer belt, and the top surface of the shield portion and the taper surface on an intermediate transfer belt side are formed from a pile fabric.

2. The image forming apparatus according to claim 1, wherein the shield portion includes:

a first base seat portion fixed to the upper surface of the cover portion;

a second base seat portion fixed to the upper surface of the cover portion in such a way as to be on the intermediate transfer belt side of the first base seat portion, the second base seat portion being softer than the first base seat portion; and a pile sheet member covering the first base seat portion and the second base seat portion, a surface of the pile sheet member being the pile fabric, and a portion of the pile sheet member covering the first base seat portion forms the top surface of the shield portion, and a portion of the pile sheet member covering the second base seat portion forms the taper surface on the intermediate transfer belt side.

3. The image forming apparatus according to claim 1, further comprising:

an image carrying member support portion configured to rotatably support a rotation shaft of the image carrying member at a position close to the front surface of the main body portion and at a position close to a rear surface of the main body portion; and a low friction portion provided on an upper surface of the image carrying member support portion located close to the front surface of the main body portion in such a way as to face the lower surface of the frame portion of the intermediate transfer unit, the low friction portion having a lower friction resistance against the intermediate transfer belt than the upper surface of the image carrying member support portion.

4. An image forming apparatus comprising:

a drum-like image carrying member disposed such that a longitudinal direction thereof matches a depth direction of a main body portion of the image forming apparatus, and configured to rotate while carrying a toner image on a valid area for image formation provided on an outer circumferential surface thereof;

an intermediate transfer unit including an endless intermediate transfer belt and a frame portion and attached to a position above the image carrying member in the main body portion from a front side of the main body portion along the depth direction in a detachable manner, the intermediate transfer belt rotating while in contact with the valid area in a top region of the rotating image carrying member such that the toner image is transferred from the image carrying member thereto, the frame portion rotatably supporting the intermediate transfer belt;

a cover portion extending in the depth direction and along a region of the outer circumferential surface of the rotating image carrying member that is more on a downstream side in a rotation direction of the image carrying member than the top region of the rotating image carrying member that is in contact with the intermediate transfer belt;

a shield portion provided on a portion of an upper surface of the cover portion that is closer to a front surface of the main body portion than the intermediate transfer belt, and configured to shield a space between the upper surface of the cover portion and a lower surface of the frame portion of the intermediate transfer unit;

an image carrying member support portion configured to rotatably support a rotation shaft of the image carrying member at a position close to the front surface of the main body portion and at a position close to a rear surface of the main body portion; and a low friction portion provided on an upper surface of the image carrying member support portion located close to the front surface of the main body portion in such a way as to face the lower surface of the frame portion of the intermediate transfer unit, the low friction portion having a lower friction resistance against the intermediate transfer belt than the upper surface of the image carrying member support portion, wherein the shield portion has a taper surface that is inclined diagonally downward from a top surface of the shield portion toward the intermediate transfer belt, and when viewed from a direction perpendicular to the depth direction, the low friction portion is formed in a shape of a mountain and is inclined diagonally downward from a top surface thereof to the front side and a rear side of the main body portion.

* * * * *